US006687943B2

(12) United States Patent
Zorzo

(10) Patent No.: US 6,687,943 B2
(45) Date of Patent: Feb. 10, 2004

(54) ANCHORING DEVICE FOR THE COVERING OF A FABRIC BROOM ON ITS ASSOCIATED SUPPORT

(75) Inventor: Bruno Zorzo, Padua (IT)

(73) Assignee: Filmop S.r.l., Villa del Conte (IT)

( * ) Notice: Subject to any disclaimer, the term of this patent is extended or adjusted under 35 U.S.C. 154(b) by 478 days.

(21) Appl. No.: 09/765,145

(22) Filed: Jan. 18, 2001

(65) Prior Publication Data

US 2001/0013153 A1 Aug. 16, 2001

(30) Foreign Application Priority Data

Feb. 11, 2000 (LU) ..... 90521

(51) Int. Cl.[7] ..... A47L 13/256

(52) U.S. Cl. ..... 15/228; 15/231; 15/233; 15/147.1; 15/150

(58) Field of Search ..... 15/147.1, 147.2, 15/150, 228, 231, 233, 229.1, 229.6

(56) References Cited

U.S. PATENT DOCUMENTS 3,339,220 A * 9/1967 Barry ..... 15/233
4,991,250 A * 2/1991 Young ..... 15/228
5,390,390 A * 2/1995 Kresse et al. ..... 15/228
5,815,878 A * 10/1998 Murakami et al. ..... 15/231
5,836,039 A * 11/1998 Rimer ..... 15/228
5,926,896 A * 7/1999 Allemann et al. ..... 15/147.2

* cited by examiner

*Primary Examiner*—Theresa T. Snider
(74) *Attorney, Agent, or Firm*—Thomas S. Baker, Jr.

(57) ABSTRACT

The present invention relates to an anchoring device for the covering (9) of a fabric boom on its associated support, which provides for extraction of the totality of the piece of fabric (9), including its extremities.

This extraction, accomplished by means of a roller extractor, is made possible by providing anchor studs (14) having an underlying recess and extending from the upper surface of the support (1-3), through the use of articulated lever-shaped connecting grips (5) on support (1-3) having an arm that exerts pressure on appendages (15) of the piece of fabric (9) without interfering with the heads of anchor studs (14), and lateral shoulders (13) on support (1-3) configured in such a way that they define between them a determinate space from which neither anchor studs (14) nor connecting grips (5) emerge.

13 Claims, 9 Drawing Sheets

Fig. 4
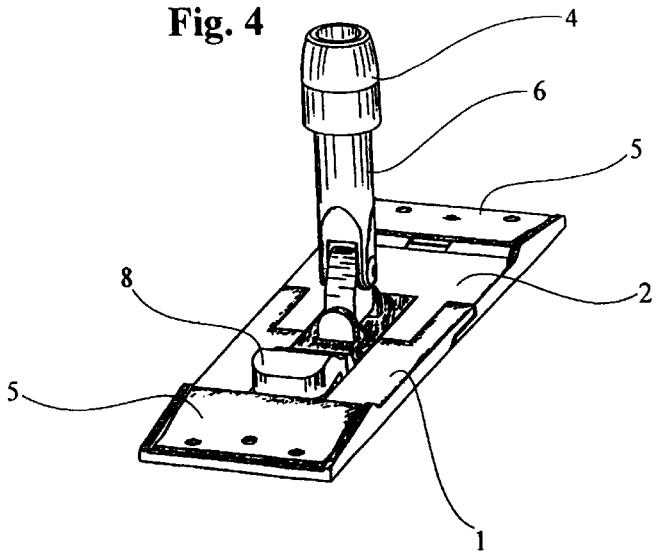
Fig. 5b
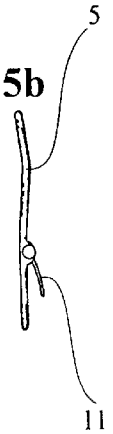
Fig. 5a
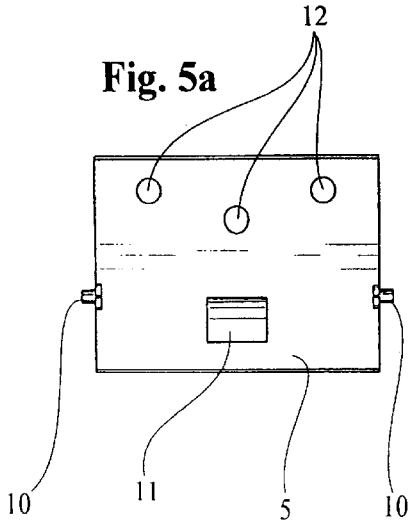
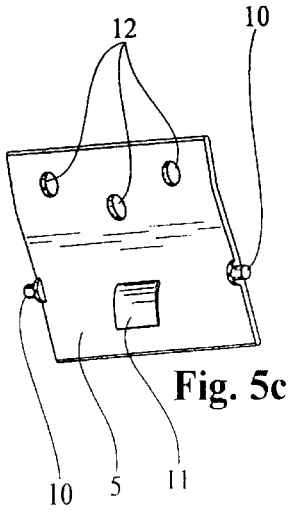
Fig. 5c

Fig. 7
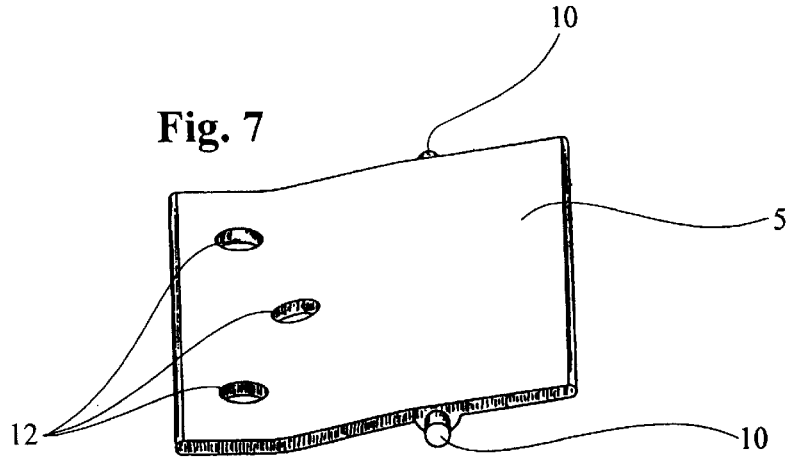
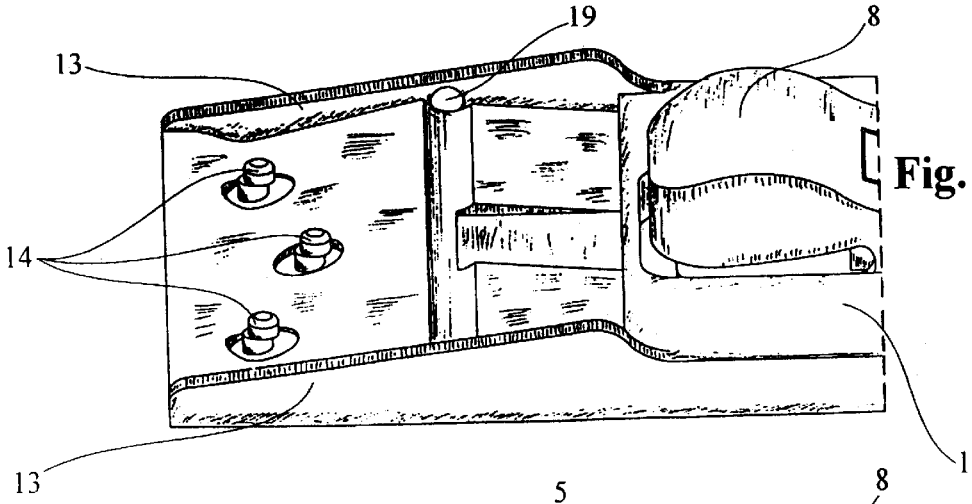
Fig. 6
Fig. 8
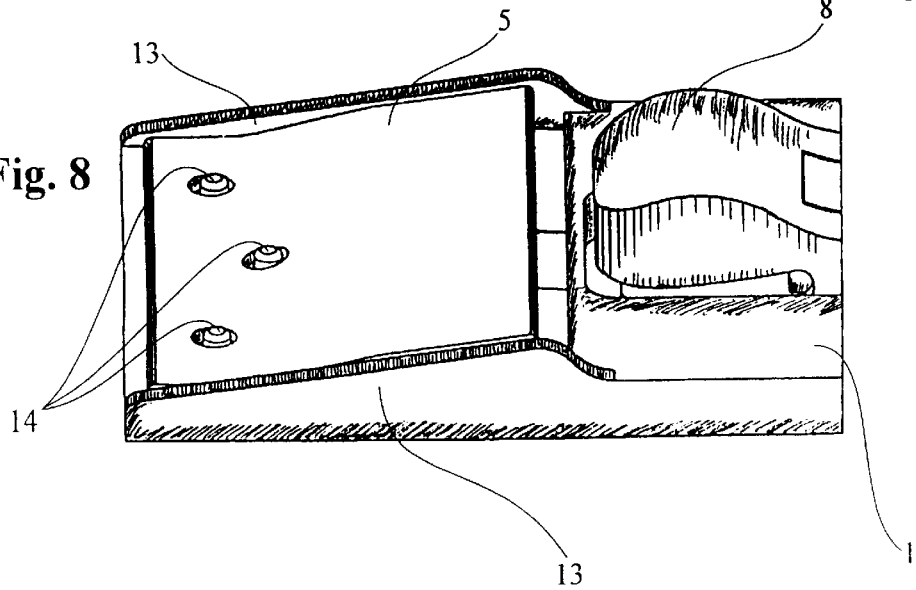

Fig. 16
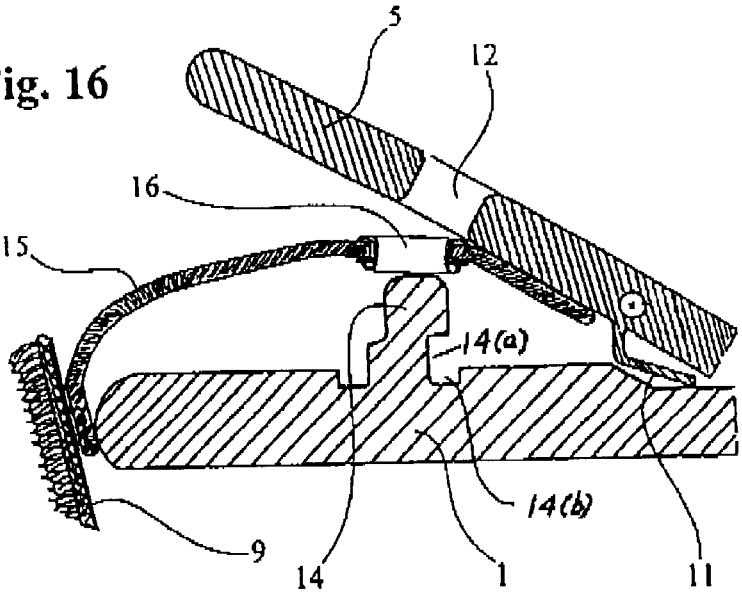
Fig. 17
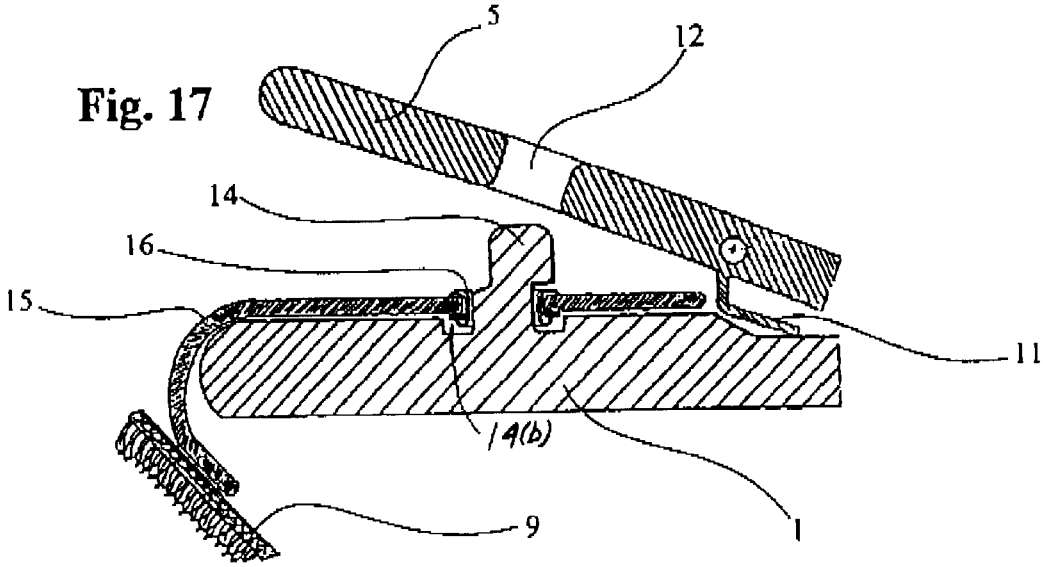
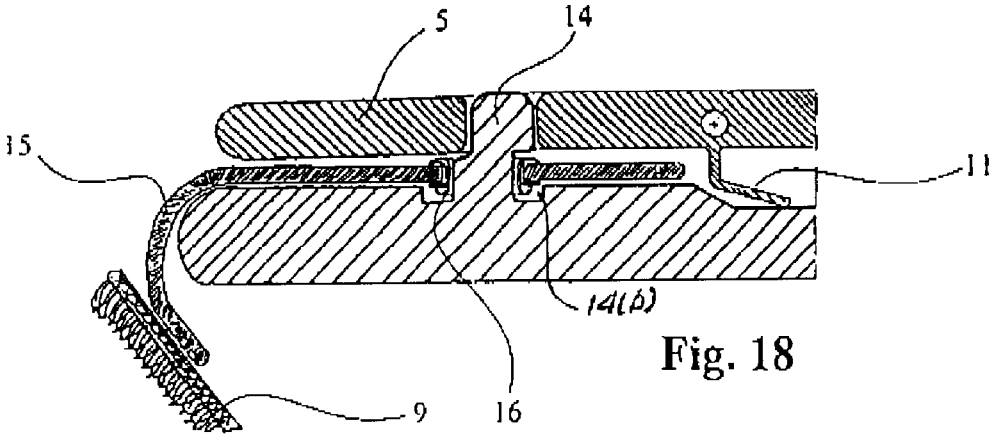
Fig. 18

ANCHORING DEVICE FOR THE COVERING OF A FABRIC BROOM ON ITS ASSOCIATED SUPPORT

BACKGROUND OF THE INVENTION

The present invention relates to a device for anchoring the covering of a fabric broom or mop on its associated support.

"Cotton brooms", as it is well known, are commonly used for cleaning floors. These brooms have an active part, consisting of a piece of fabric, which is stretched and maintained in its working position by an associated support in the form of a small panel.

This support, generally made of a resinous plastic material, is composed of several interconnected articulated pieces that are rendered coplanar during normal cleaning operations. The central area of the support has an attachment for the broom handle.

The fabric piece is held in place on the support by means of appendages provided on the extremities of the fabric, through two lever-shaped grips, articulated in seats formed in projections that extend laterally from the extremities of the upper surface of the support.

For proper operation of the above-mentioned broom, it is necessary to maintain adequate tension on the piece of fabric, and a secure attachment of the fabric so that it does not yield when subjected to any unusual demands such as, for example, the insertion of the fabric piece into cracks or the presence of rough spots on a floor being cleaned; it is also necessary that the entire piece of fabric, including its extremities, be capable of being squeezed dry.

With respect to the tension and attachment of the fabric, the means that have been used until today on various types of brooms have been effective. However, methods for squeezing the fabric dry have not yet been completely effective.

In fact, whenever the piece of fabric must be squeezed out, the support, held in place in the center by the handle, is snapped open and its component parts are no longer in parallel alignment, which results in the extremities of the support assuming a downwardly inclined position and the piece of fabric, which is held in place by means of its appendages by the support grips, assumes the configuration of a hanging swag. The extremities of the piece of fabric are no longer completely below the support at this point but partially resting on the support itself.

Prior to immersion for washing and rinsing, the piece of fabric is inserted into an extraction device.

Obviously, the compression obtained with the different types of extraction device affects the portion of the piece of fabric found below the solid components of the support. The portions of the piece of fabric that are resting on the support naturally have to be extracted (squeezed out). This means that the piece of fabric isn't completely cleaned and continues to have non-extracted parts impregnated with dirty liquid. The effects of this situation are generally manifest during floor cleaning activities. Nor does the use of an extraction device having opposed rollers succeed in completely extracting the piece of fabric. Given the structure of current supports, the rollers are incapable of turning while comprising between them the solid parts of the support and, as a result, are incapable of extracting the extremities of the piece of fabric opposed to the support.

The present invention remedies the above difficulties and provides complete extraction of the piece of fabric, including its extremities, while maintaining appropriate active tension on the piece of fabric and a proper grip on the appendages provided on the piece of fabric.

We describe below the innovations provided by the invention, with respect to current technology, for obtaining complete extraction of the entire piece of fabric, including its extremities.

First: Studs, having an underlying recess, are provided on the upper surface of the support, near its extremities. These studs present cutouts that realize appropriate recesses along a section of their lower part, extending from their region of attachment. The edges of the holes (which may or may not be reinforced with grommets) formed in the appendages of the piece of fabric are inserted into the recesses and consequently, whenever the piece of fabric is stretched, these holes prevent the appendages from lifting up and disengaging from the studs.

Second: The connecting grips have, according to the invention, the shape of a lever, with roughly equal arms. Pins or journals on these lever-shaped grips swivel about lateral shoulders provided near the extremities of the support. The lever arm extending toward the interior of the support is pushed upward by means of an underlying spring, while the opposed lever arm, which extends toward the exterior, is consequently pushed downward while compressing, against the support, the appendages of the piece of fabric, which are connected to the anchoring studs, thus preventing the appendages from disengaging. To enable the arm to assume its function, it is provided with holes in such a way that interference with the underlying studs on the support is prevented.

Third: The lateral shoulders provided along the extremities of the support are designed in such a way as to define, between them, a space in which the connecting studs joined to the support as well as the connecting lever-shaped grips are held in place even when said grips compress the appendages of the piece of fabric inserted beneath these grips.

SUMMARY OF THE INVENTION

With these three innovations, we obtain the advantages described below, said innovations being: Studs with underlying recess that extend from the upper surface of the support, the lever-shaped grips articulated on the support, having an arm that exerts pressure on the appendages of the piece of fabric without interfering with the heads of the studs, and the lateral shoulders of the support, which are appropriately shaped so as to define a determinate space between them, from which space neither the studs with the underlying recess nor the connecting grips emerge.

During the cleaning phase, the piece of fabric is stretched appropriately and efficiently attached, its appendages being engaged by their associated holes in the recesses on the connecting studs. When the external parts of the support are in an angular position, the appendages cannot he dislodged from the connecting studs because they are pressed against the support lever arm on each of the connecting grips. During the extraction phase, the presence of the lateral shoulders of the support, whose contour decreases toward the extremity, enable the extremities of the piece of fabric to be extracted whenever an extraction device having opposed rollers is used. These rollers, which turn freely against the lateral shoulders of the support, encounter the terminal regions of the piece of fabric which are opposed to the top of the extremities of the arm of the lever exerting pressure, and thus subjected to extraction.

It should be noted that the piece of fabric is realized, both in length and width, with dimensions that are greater than those of the support, because during cleaning, the fabric may come into contact with the edges and contours of various articles of furniture.

In fabric brooms currently on the market, the portions of the piece of fabric that are longitudinally stretched above the support are not subjected to extraction, and a good portion of the dirt collected during a previous cleaning phase continues to be transported during successive cleaning phases, which alters the quantity and quality of the cleaning process itself.

Another innovative feature compared to existing fabric brooms on the market is inherent in the articulated device on one of the support elements, which, when pressed, is released from the small nose on the contiguous element opposite the support. This release results in the suppression of the planarity of the interarticulated elements constituting the support. This articulated device is realized from a single molded piece, comprising a lip that covers the small nose on the contiguous opposed element, which exists whenever the user wishes to maintain the planarity of the interarticulated elements constituting the support, as well as the articulating pins or journals themselves and the elastic branches that function as springs, which determine the load during operation. This results in a significant economic advantage because of the reduction of manufacturing costs, given that the unit is reduced during molding to a single piece and because of the time savings gained over the assembly of separate components.

Below we describe an embodiment of the present invention, which refers to the attached drawings, said embodiment being non-limiting and provided for illustrative purposes only.

BRIEF DESCRIPTION OF THE DRAWINGS

FIG. 4 is a perspective view of the anchoring device;

FIG. 5A is a bottom view of a connecting grip;

FIG. 5B is a side view of a connecting grip;

FIG. 5C is a perspective view of the connecting grip of FIG. 5A;

FIG. 6 is an enlarged perspective view of one end of the anchoring device;

FIG. 7 is a top perspective view of the connector grip of FIG. 5A;

FIG. 8 is an enlarged perspective view of one end of the anchoring device with the connecting grip of FIG. 5A attached thereto;

FIGS. 16 through 18 illustrate sequentially the attachment of the fabric element to the anchoring device;

DETAILED DESCRIPTION

Figure 1:
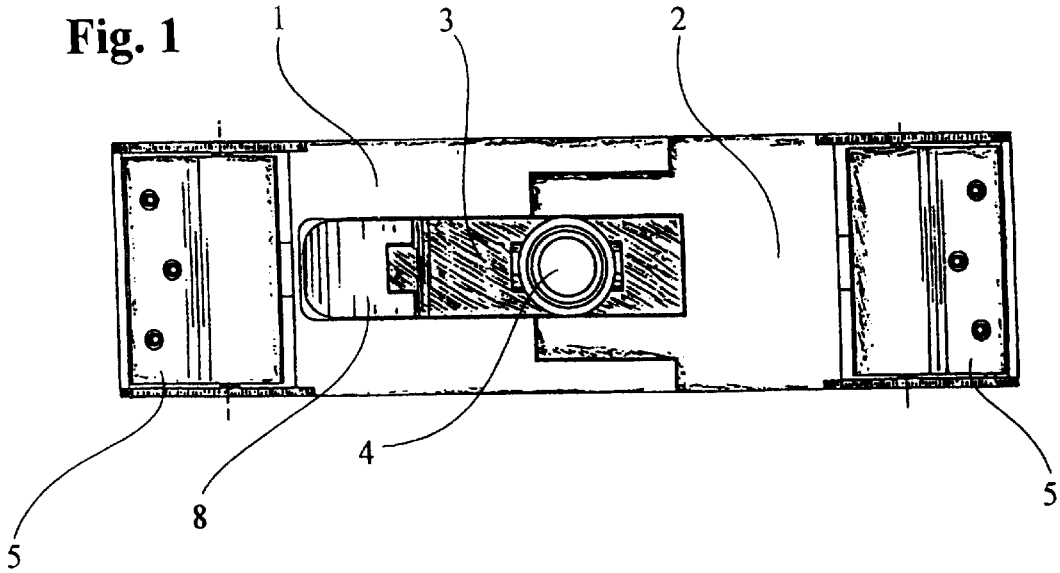
FIG. 1 is a plan view of the fabric broom anchoring device.

FIG. 1 is a plan view of the support for a fabric broom or mop. The illustration shows that the support consists of several elements (1,2,3), which are connected to one another and provide, at their extremities, with lever-shaped connecting grips (5) halving roughly equal arms.

Figure 2:
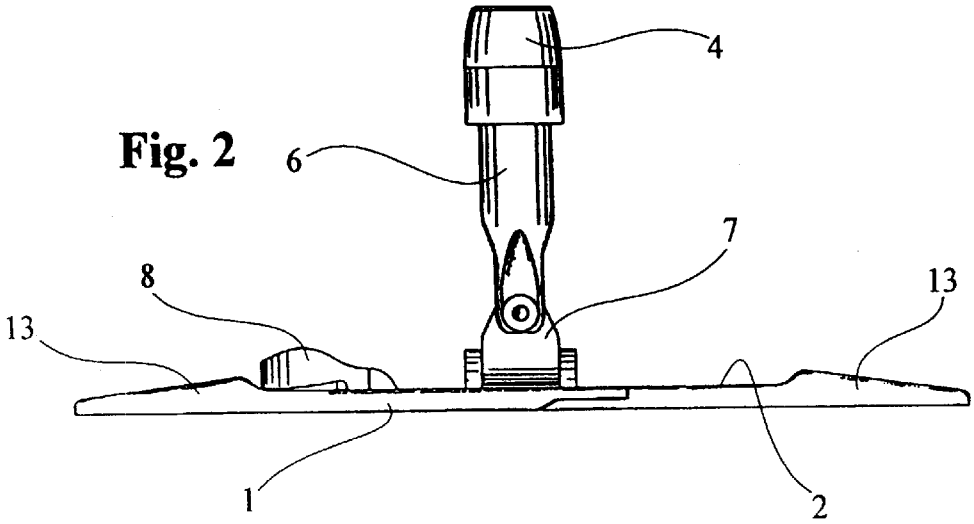
FIG. 2 is a front view of the fabric broom anchoring device.

FIG. 2 is a side view of the support for a fabric broom or mop whose constituent elements (1,2) are coplanar with one another. The drawing illustrates broom handle connectors (4,6) connected by articulated device (7) to support (1,2), and button (8), which maintains the small nose of the opposed central element, emerging from the profile of the two lateral shoulders (13) of the support.

Figure 3:
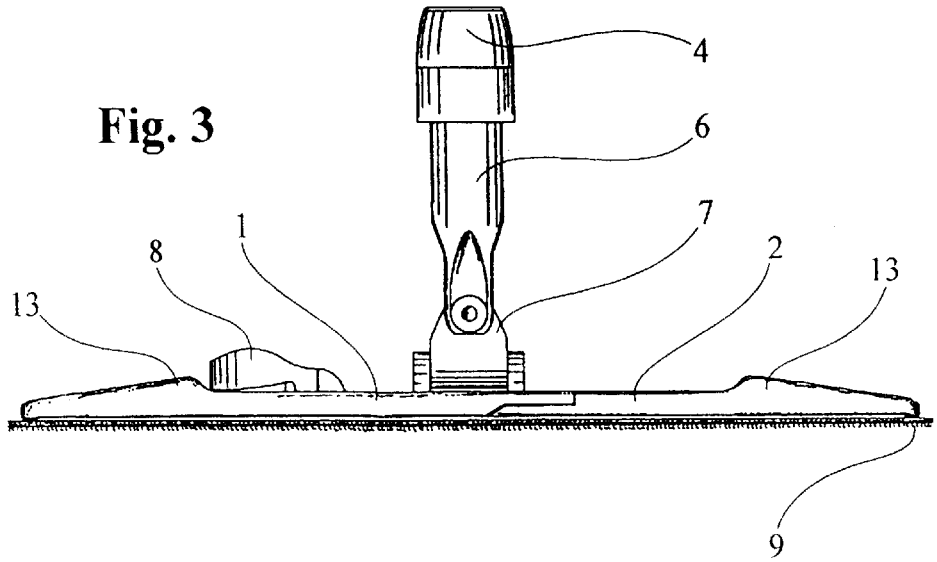
FIG. 3 is a front view similar to FIG. 2 illustrating a fabric broom attached to an anchoring device.

FIG. 3 is a side view corresponding to FIG. 2, wherein support (1,2) maintains piece of broom or mop fabric (9). In this illustration the connecting grips do not extend above the contours of the lateral shoulders (13) on the support.

FIG. 4 is a perspective view of the fabric broom support shown in FIG. 1.

FIG. 5A is a bottom view of one of the two lever-shaped connecting grips (5).

FIG. 5C is a perspective view of the connecting grip represented in FIG. 5A.

FIG. 5B is a profile view of the connecting grip represented in FIG. 5A. One will note the presence, on one of the two arms of the lever, of the three holes (12) through which pass the heads of studs (14) (described below), which rise form the upper surface of the support and, on the other arm of the lever, a laminar elastic appendage (11) serving as a spring. The articulating pins or journals (10) are nearly centrally located with respect to the two arms.

FIG. 6 is a perspective view from above of an extremity of a fabric broom support according to the present invention. The support lacks the connecting grip. The figure shows the three anchor studs (14) that rise from a hollow or recessed area in the upper surface of the support. FIG. 6 also shows lateral shoulders (13), which rise from both sides of the support, having the shape of a ramp that slopes down to the extremity of said support. The inner part of one of the shoulders (13) reveals a seat (19) for one of the two pins or journals (10) on the lever-shaped connecting grip, which grip is not shown.

FIG. 7 is a perspective view from above of a lever-shaped connector grip (5), not mounted. This figure also shows holes (12) provided for passage of anchor studs (14), and the articulating pins or journals (10).

FIG. 8 is a perspective view from above of the extremity of the support for a corresponding fabric broom, but with the connecting grip (5) represented in FIG. 6 now in place.

Figure 9:
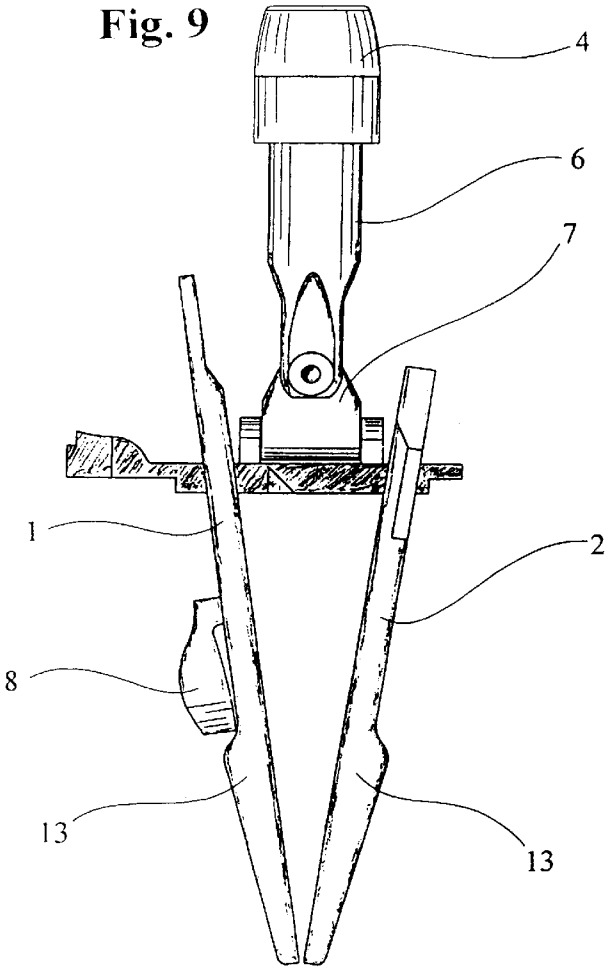
FIG. 9 is a front view of the anchoring device illustrating the fabric broom support elements released and extending downwardly therefrom.

FIG. 9 is a side view of the fabric broom support, with elements (1,2) constituting this support and forming an angle between them. The figure shows that lateral elements (1,2) of the support are inclined downwards, being supported from the central element about which they swivel. The anchor studs with underlying recesses and lever-shaped connecting grips do not extend beyond lateral shoulders (13), provided along the extremities or sides of elements (1,2).

Figure 10:
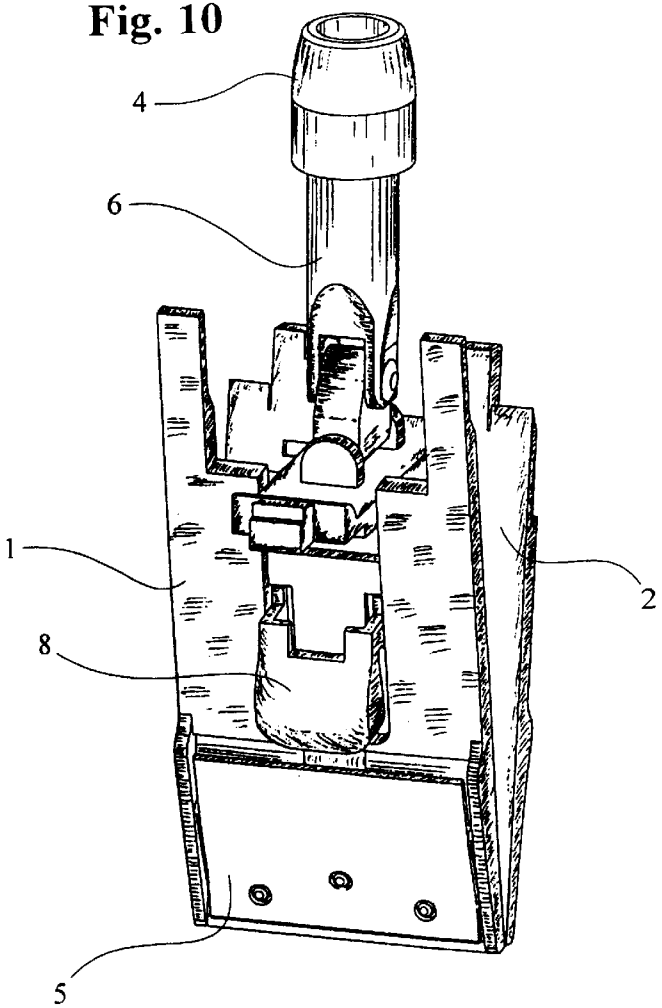
FIG. 10 is a perspective view of the anchoring device illustrated in FIG. 9.

FIG. 10 is a perspective view of the fabric broom support maintained by handle connector (6), whose lateral elements (1,2) form a downward-pointing angle.

Figure 11:
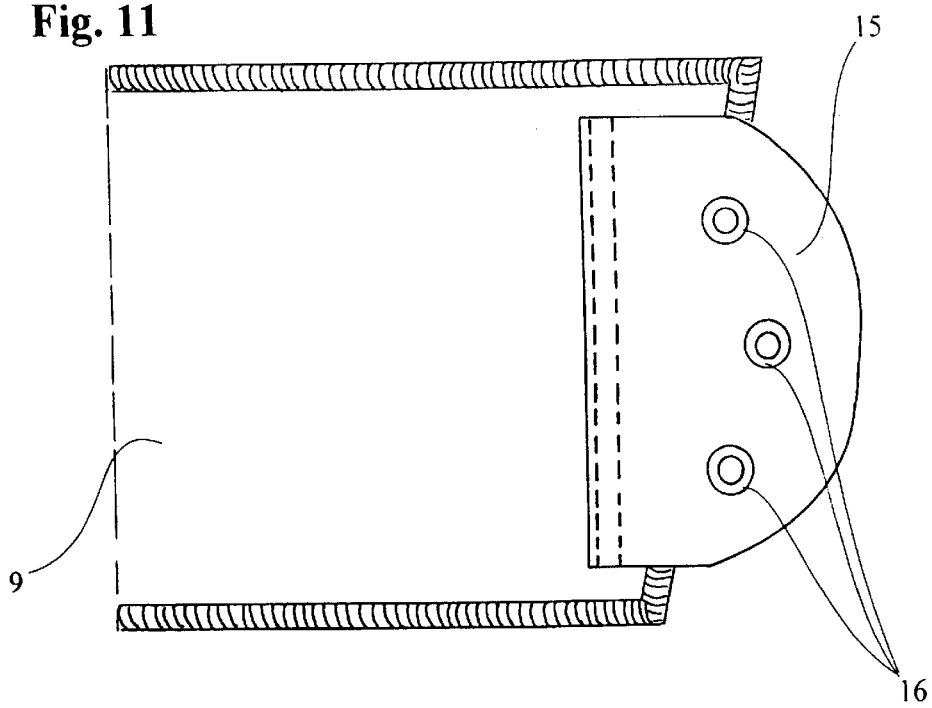
FIG. 11 is a top view of a fabric broom element.

FIG. 11 represents a portion of the piece of broom or mop fabric (9) to which is attached a laminar appendage (15) provided with holes (16) reinforced with grommets. Appendage (15) is shown extended outward.

Figure 12:
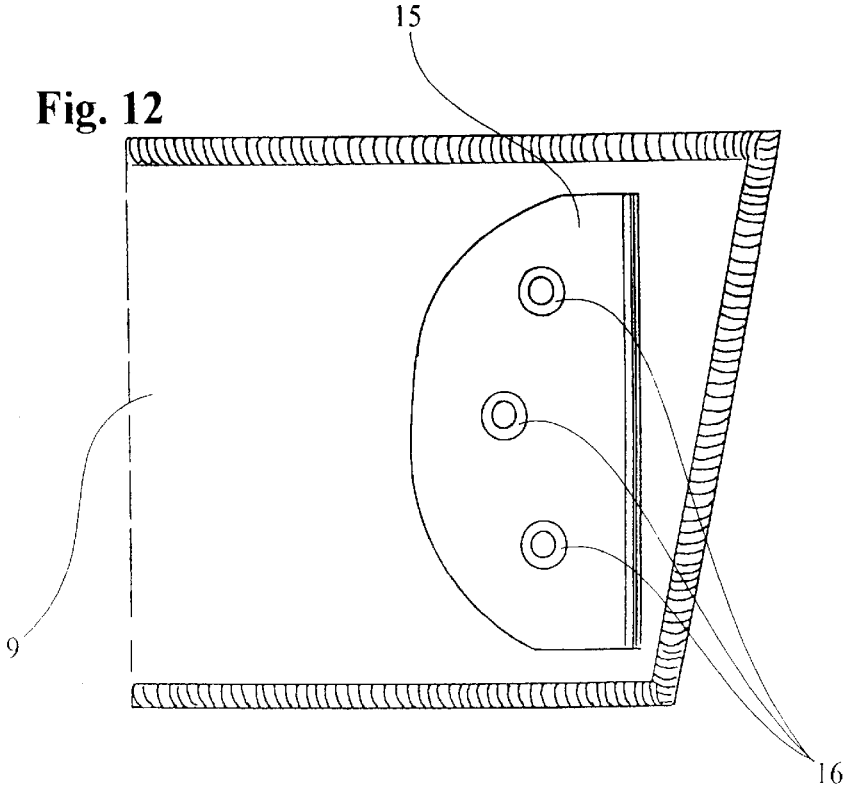
FIG. 12 is a view similar to FIG. 11 illustrating support for the fabric broom element folded over on itself.

FIG. 12 represents the portion of the piece of fabric (9) illustrated in FIG. 11 in the situation where appendage (15), provided with holes (16), is folded over on itself, which occurs whenever it must be inserted below the presser arm of a connecting grip (5), said arm having been previously raised.

Figure 13:
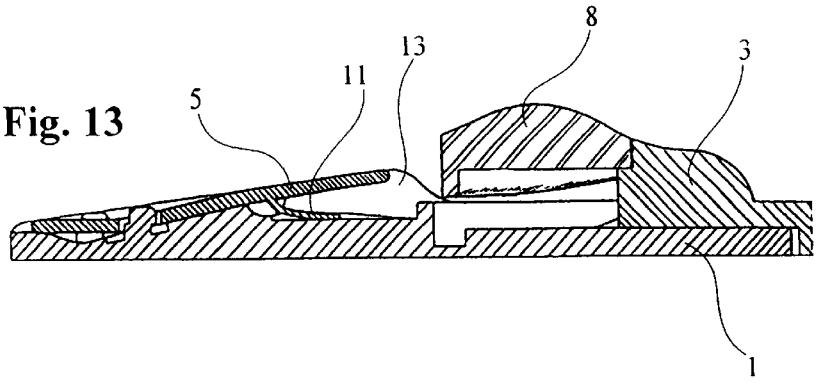
FIG. 13 is a longitudinal section of one side of the anchoring device.

FIG. 13 is a longitudinal center cutaway of a portion of the fabric broom support provided with connecting grip (5). The drawing shows connecting studs of support (1), one of the lateral shoulders (13), and spring (11), which determines the amount of pressure exerted by the lever arm against the surface of the extremity of the support.

Figure 14:
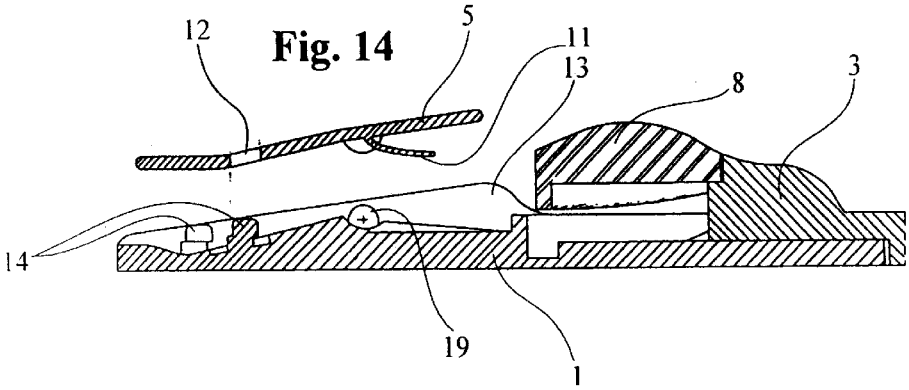
FIG. 14 is a view similar to FIG. 13 showing a connecting grip spaced above the device.

FIG. 14 is a view corresponding to that in FIG. 13 but with connecting grip (5) not attached to the structure of support (1).

Figure 15:
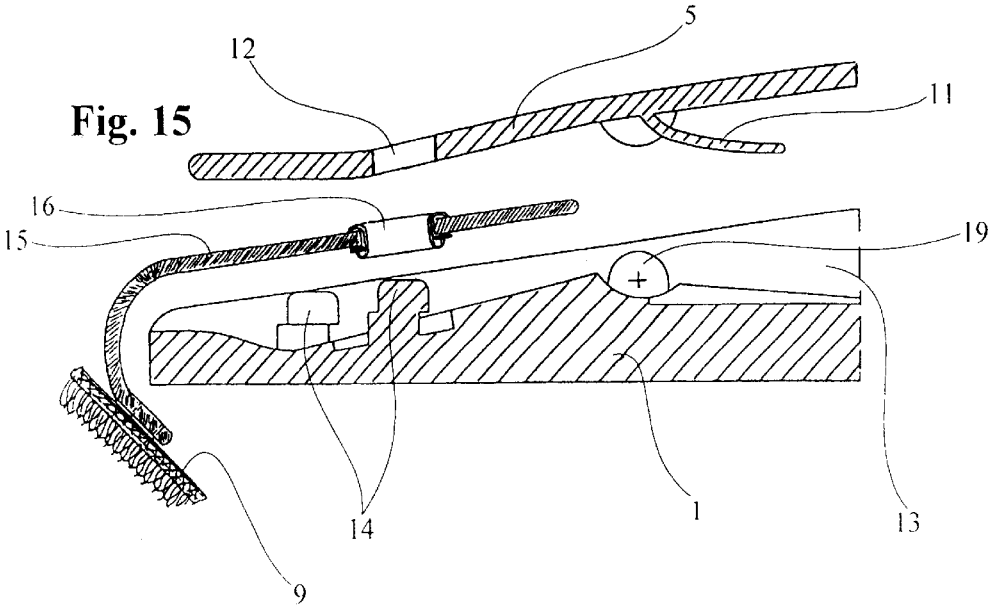
FIG. 15 is an enlarged view of FIG. 14 illustrating the attachment of a fabric broom element to the anchoring device.
Figure 19A:
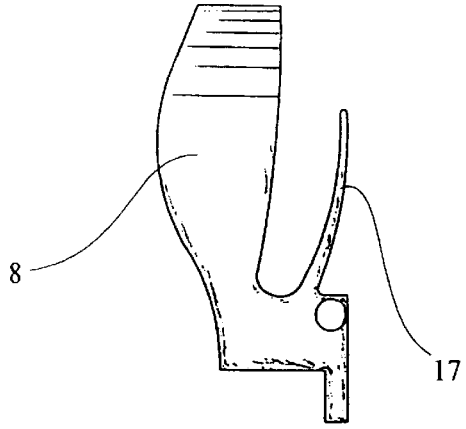
FIG. 19A is a side view of an articulated button.
Figure 19B:
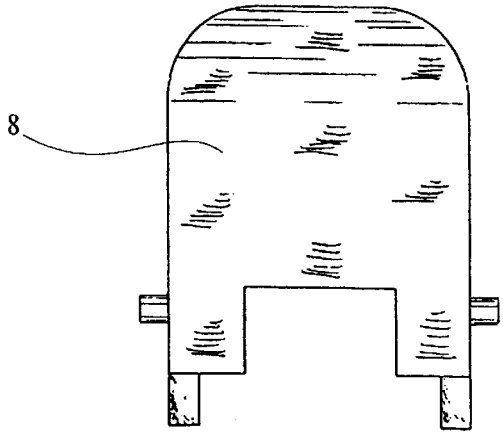
FIG. 19B is a top view of the button of FIG. 19A.
Figure 19D:
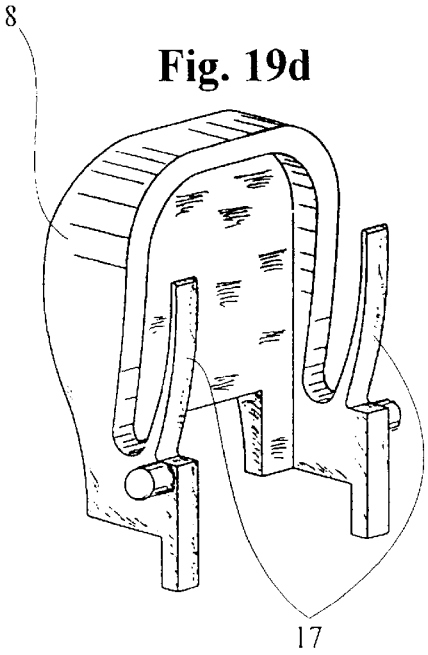
FIG. 19D is a perspective view of the bottom portion of the articulated button depicted in FIG. 19A.
Figure 19C:
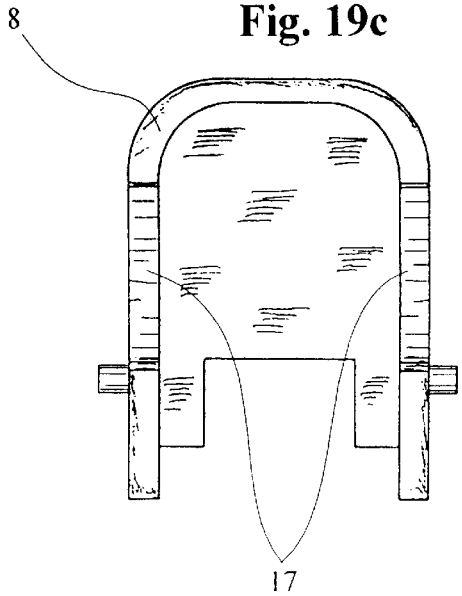
FIG. 19C is a bottom view of button of FIG. 19A.

FIG. 15 is a larger-scale view corresponding the that shown in FIG. 14 and illustrates laminar appendage (15), pierced with holes (16) reinforced with grommets, of the piece of fabric (9) arranged between support (1) and lever-shaped connecting grip (5) (the latter being shown not attached).

FIG. 16 is a cutaway that schematically illustrates the insertion of appendage (15), pierced with holes (16), of fabric piece (9) beneath lever-shaped connecting grip (5), with said appendage about to be engaged by one of its grommet-reinforced holes (16) to anchor stud (14) with underlying recess, which rises from the surface of support (1).

FIG. 17 schematically illustrates the insertion phase following that shown in FIG. 16, in which hole (16), reinforced by a grommet, in laminar appendage (15), has Green inserted over anchor stud (14) and engaged in the underlying recess present in :he lower part of anchor stud (14).

FIG. 18 is a schematic representation of the (final) phase, which succeeds the phase represented by FIG. 17, in which the lever arm of the lever-shaped connecting grip (5) compresses laminar appendage (15) of fabric (9) against the upper surface of the support. The pressure exerted by the lever arm prevents appendage (15) on fabric piece (9) from lifting up and specifically prevents the grommet that reinforces hole (16) from disengaging from the underlying recess on anchor stud (14) to which it is connected. Preventing appendage (15) from lifting off is important when the piece of fabric (9) is not stretched as is the case whenever elements (1–3) of the support are not planar (especially during the extraction phase).

FIGS. 19A, 19B, 19C, and 19D are, respectively, profile, top, bottom and bottom perspective views of articulated button (8), which, by resting against the small nose of the contiguous and opposite support element about which said button is articulated, ensures that elements (1,2,3), constituting the support, are maintained in planar position, and which, when pressed down, frees the small nose and ensures that various elements (1,2,3) on the support are no longer coplanar. These illustrations show that the articulated pins or journals and elastic branches (17) serving as a spring form a single body.

Figure 20:
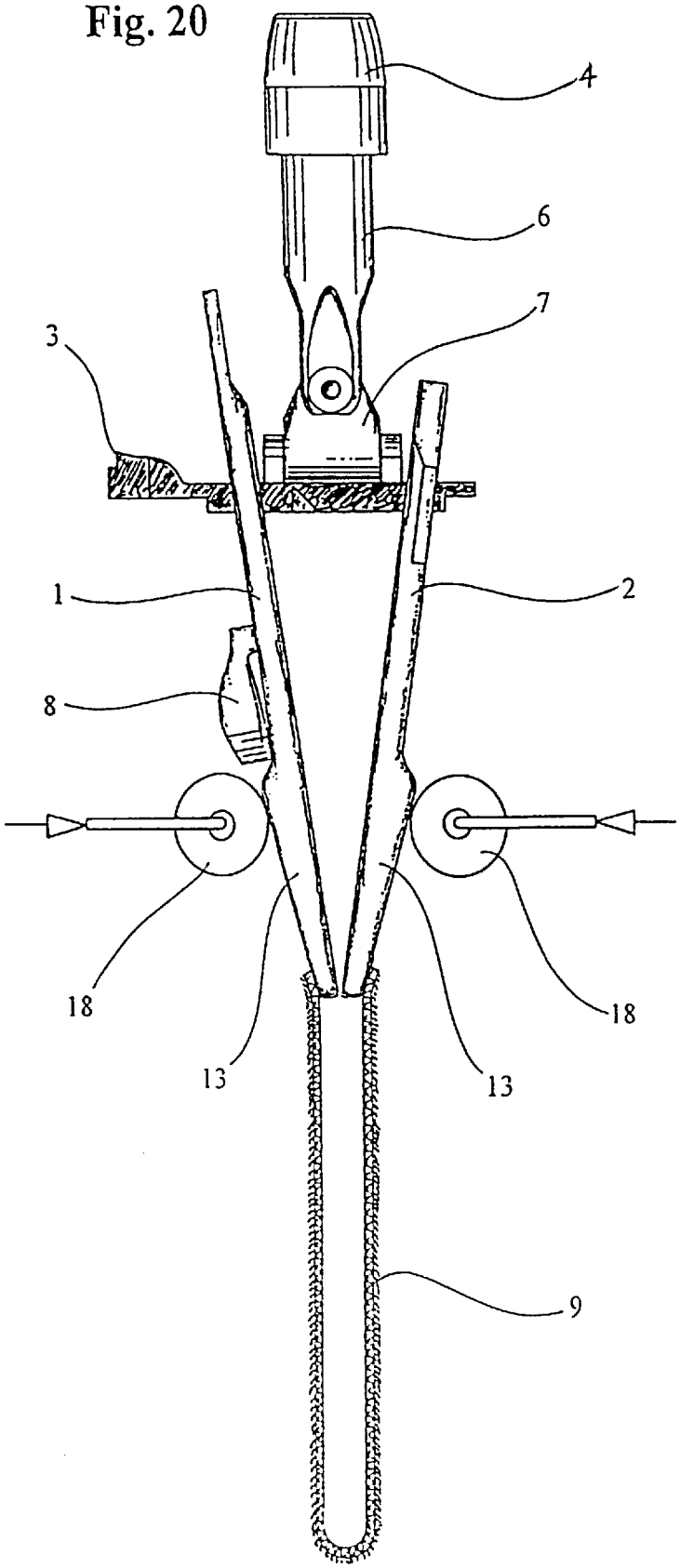
FIG. 20 is a view of the anchoring device similar to FIG. 9 with fabric broom element attached thereto illustrating schematically the engagement of extraction rollers.

FIG. 20 is a view of the support corresponding to that shown in FIG. 9 and illustrates the piece of fabric (9) maintained by means of its appendages and lever-shaped connecting grips, which prevent the grommets on the holes of the appendages from disengaging from the underlying recesses of the anchor studs, so that fabric piece (9)hangs freely and is ready to be extracted. FIG. 20 schematically represents two pressure rollers (18) of an extraction device, which are about to go into action on shoulders (13) of supports (1,2). During their descent, extraction rollers (18) initially act on the extremities of fabric piece (9) opposed to support (1I,2), then on the part hanging from support (1,2), thus producing complete extraction of the totality of fabric piece (9).

The preceding description illustrates the validity of the present invention for improving the anchoring systems of the extremities of broom or mop fabric piece (9), which covers the support of a fabric broom, and provides for the complete extraction of fabric piece (9) by means of a roller extraction device, including the extremities of said fabric piece (9).

Although the invention has been represented and described by means of embodiments provided for illustrative purposes, those skilled in the art will easily understand that various alterations, omissions, and additions could be made to the invention without exceeding its scope in any way.

What is claimed is:

1. Anchoring device for attaching a mop fabric, comprising a support (1,2,3) having two coplanar articulated support elements each support element having an upper surface, a lower surface and an outer end extremity a lever-shaped grips (5) adjacent each outer end extremity, said mop fabric (9) having a flexible laminar appendages (15) at one end thereof, one or more anchor studs (14) extending from said upper support element surfaces which have an underlying recess (14(*a*)) adapted to engage said laminar appendages and wherein said lever-shaped grips (5) overlie said appendages.

2. Anchoring device for attaching a mop fabric according to claim 1, wherein the anchor studs (14) that extend from the upper support element surfaces are surrounded by a recessed area (14(*b*)) formed in said articulated support elements (1,2) adapted to receive, the laminar appendages (15) of the mop fabric (9).

3. Anchoring device for attaching a mop fabric according to claim 2, further comprising lateral shoulders formed on said support elements (1,2) wherein said lever-shaped grips (5) have articulating pins (10) which engage seats (19) formed in the lateral shoulders (13) and are adapted to engage and secure said mop fabric appendages (15).

4. Anchoring device for attaching a mop fabric according to claim 3, wherein said lever-shaped grips (5) have two substantially equal length arms, one lever arm of each grip (5) extending toward the central part of said support element each grip having a spring (11), which maintains it in a raised position, and wherein the other lever arm on each grip (5), extends toward said outer end extremity.

5. Anchoring device for attaching a mop fabric, according to claim 4, wherein said other lever arm of grip (5) is provided with holes (12), located complementary to the anchor studs (14) such that said lever arm can descend freely against the plane of the support without interference from said studs.

6. Anchoring device for attaching a mop fabric according to claim 4, wherein said spring (11), is molded with said lever arm.

7. Anchoring device for attaching a mop fabric according to claim 1, further comprising lock device (8) having a first position for maintaining the planar configuration of the articulated support elements (1,2) and a second position to enable said support element to move from said planar configuration when pressed, said lock device (8) having a unitary body formed during a molding operation, said lock device also having articulating studs and elastic elements (17) forming springs that bias it toward said first position.

8. Anchoring device for attaching a mop fabric according to claim 1, wherein said laminar appendages (15) of said mop fabric have holes (16), positioned to correspond to the positions occupied by the anchor studs (14).

9. Anchoring device for attaching a mop fabric according to claim 8, wherein the holes (16) provided in the appendages (15) of the mop fabric (9) are provided with grommets made of a rigid material.

10. Anchoring device for attaching a mop fabric according to claim 8, wherein the appendages (15) of the mop fabric (9) are pierced with holes (16) and have a width corresponding to the internal distance between the shoulders (13) of the support (1,2), so that they are self-centering when inserted below the grips (5), ensuring that their holes (16) correspond to the position of the anchor studs (14) present on the upper surface of the support (1,2), to facilitate their connection with the anchor studs (14).

11. Anchoring device for attaching a mop fabric comprising a support (1,2,3) having two articulated support elements (1,2) each having an upper surface, a lower surface and an outer end extremity, a lever-shaped grip positioned adjacent each said support element outer end extremity, lateral shoulders (13) formed on said support elements which define a space which receives a plurality of anchor studs which extend upwardly from each of said support element outer end extremities and adapted to receive an appendage attached to said fabric mop, a lever-shaped grip (5), attached to each outer end extremity and moveable to a closed position to thereby secure the appendages (15) of the mop fabric (9) to said outer extremity and wherein said lateral shoulders (13) extend upwardly above said anchor studs (14) such that when the mop fabric (9) is being extracted, extraction rollers (18) may pass freely over the shoulders (13) without interference from said anchor studs (14).

12. Anchoring device for attaching a mop fabric according to claim 11, wherein the appendages (15) of the mop fabric (9) are pierced with holes (16) and have a width corresponding to the internal distance between the shoulders (13) of the support (1,2), so that they are self-centering when inserted below the grips (5), ensuring that their holes (16) correspond to the position of the anchor studs (14) present on the upper surfaces of the support (1,2), to facilitate their connection with the anchor stud (14).

13. Anchoring device for attaching a mop fabric comprising a support (1,2,3) having two articulated support elements (1,2) each having an upper surface, a lower surface and an outer end extremity, a lever-shaped grip positioned adjacent each said support element outer end extremity, lateral shoulders (13) formed on said support elements which define a space which receives a plurality of anchor studs which extend upwardly from each of said support element outer end extremities and adapted to receive an appendage attached to said fabric mop, a lever-shaped grip (5), attached to each outer end extremity and moveable to a closed position to thereby secure the appendages (15) of the mop fabric (9) to said outer extremity, wherein the appendages (15) of the mop fabric (9) are pierced with holes (16) and have a width corresponding to the internal distance between the shoulders (13) of the support (1,2) so that they are self-centering when inserted below the grips (5), ensuring that their holes (16) correspond to the position of the anchor studs (14) present on the upper surface of the support (1,2) to facilitate their connection with the anchor studs (14).

* * * * *